US008668374B2

(12) United States Patent
Yoo

(10) Patent No.: US 8,668,374 B2
(45) Date of Patent: Mar. 11, 2014

(54) OPTICAL SEMICONDUCTOR BASED ILLUMINATING APPARATUS

(71) Applicant: POSCO LED Company Ltd., Seongnam-si (KR)

(72) Inventor: Min Uk Yoo, Seongnam-si (KR)

(73) Assignee: POSCO LED Co., Ltd., Seongnam-si (KR)

( * ) Notice: Subject to any disclaimer, the term of this patent is extended or adjusted under 35 U.S.C. 154(b) by 0 days.

(21) Appl. No.: 13/628,638

(22) Filed: Sep. 27, 2012

(65) Prior Publication Data

US 2013/0279166 A1 Oct. 24, 2013

(30) Foreign Application Priority Data

Apr. 23, 2012 (KR) ..... 10-2012-0042046

(51) Int. Cl.
*H01R 33/00* (2006.01)

(52) U.S. Cl.
USPC ..... 362/651; 362/289

(58) Field of Classification Search
USPC ..... 362/289, 363, 443, 455, 457, 647, 649, 362/651, 655, 365
See application file for complete search history.

(56) References Cited

U.S. PATENT DOCUMENTS

| | | | | |
|---|---|---|---|---|
| 7,422,341 | B2 * | 9/2008 | Henrici et al. | 362/92 |
| 7,568,830 | B2 * | 8/2009 | Hsu | 362/655 |
| 2002/0163808 | A1 * | 11/2002 | West et al. | 362/255 |
| 2011/0149552 | A1 * | 6/2011 | Atalay | 362/92 |

FOREIGN PATENT DOCUMENTS

| | | |
|---|---|---|
| CN | 101506571 | 8/2009 |
| JP | 10-340615 | 12/1998 |
| JP | 11-353924 | 12/1999 |
| JP | 2000-100236 | 4/2000 |
| JP | 2011-134665 | 7/2011 |
| JP | 2011-159472 | 8/2011 |
| TW | 290832 | 11/1996 |
| TW | 445355 | 7/2001 |

OTHER PUBLICATIONS

Japanese Office Action issued on Jul. 3, 2012 in Japanese Patent Application No. 2012-117300.
Taiwan intellectual Property Office (TIPO) Preliminary Notice of First Office Action dated Sep. 18, 2013 for TW Patent Application No. 101139303.

* cited by examiner

*Primary Examiner* — Julie Bannan
(74) *Attorney, Agent, or Firm* — H.C. Park & Associates, PLC

(57) ABSTRACT

An optical semiconductor based illuminating apparatus includes a first unit which is disposed on an upper side of a housing and includes protrusions formed on a lower outer side of an optical member surrounding a semiconductor optical device and having an inclined surface inclined upwards from a lower edge of an optical member; and a second unit which accommodates and holds the first unit, so that it can reduce defect rate, improve assembly efficiency, and has excellent durability.

10 Claims, 3 Drawing Sheets

OPTICAL SEMICONDUCTOR BASED ILLUMINATING APPARATUS

CROSS REFERENCE TO RELATED APPLICATION

This application claims priority from and the benefit of Korean Patent Application No. 10-2012-0042046, filed on Apr. 23, 2012, which is hereby incorporated by reference for all purposes as if fully set forth herein.

BACKGROUND

1. Field

Exemplary embodiments of the present invention relate to an optical semiconductor based illuminating apparatus, and more particularly to an optical semiconductor based illuminating apparatus which can reduce defect rate, improve assembly efficiency, and has excellent durability.

2. Discussion of the Background

Optical semiconductor devices such as light emitting diodes (LEDs) or laser diodes (LD) have attracted increasing attention due to advantages such as low power consumption, long lifespan, high durability, and excellent brightness, as compared with incandescent lamps or fluorescent lamps.

Some illuminating apparatuses based on the optical semiconductor have a structure wherein a housing provided with a heat sink or the like is coupled to a socket base having the same shape as that of a halogen lamp or the incandescent lamp, the optical semiconductor is arranged as a light source in the housing, and an optical member surrounding the optical semiconductor is mounted to the housing.

Such an optical semiconductor based illuminating apparatus may employ various methods for mounting the optical member on the housing. For example, a groove is formed along a top edge of the housing, and a ring-shaped projection is formed along a lower edge of the optical member, such that the optical member and the housing can be coupled to each other by forcibly fitting the projection into the groove (hereinafter, referred to as a "first method").

Also, in order to mount the optical member on the housing, an adhesive may be applied along the lower edge of the optical member to attach the optical member to the housing (hereinafter, referred to as a "second method").

The first method ensures coupling force. However, it is very difficult to manage tolerance between the projection and the groove. In addition, productivity is lowered since pressure for force fitting is applied to both the optical member and the housing to couple them to each other, and increase in unit cost of components including the optical member and the housing is unavoidable.

The second method takes time to apply the adhesive along the lower edge of the is optical member, thereby lowering productivity. Further, since work performance can vary according to the kind of adhesives, it is difficult to maintain coupling force after the optical member and the housing are coupled, thereby causing defects.

In particular, the second method has a problem in that the optical member is detached from the housing as adhesion of the adhesive is lowered due to heat generated from the illuminating apparatus.

The above information disclosed in this Background section is only for enhancement of understanding of the background of the invention and therefore it may contain information that does not form any part of the prior art nor what the prior art may suggest to a person of ordinary skill in the art.

SUMMARY OF THE INVENTION

Exemplary embodiments of the present invention provide an optical semiconductor based illuminating apparatus, which can reduce defect rate, improve assembly efficiency, and has excellent durability.

In accordance with one aspect, exemplary embodiments of the present invention provide an optical semiconductor based illuminating apparatus including: a housing; at least one semiconductor optical device formed on an upper side of the housing; an optical member disposed on the upper side of the housing; a first unit formed on a lower outer side of the optical member and comprising a protrusion having an inclined surface inclined from a lower edge of the optical member; and a second unit formed on the upper side of the housing to accommodate and hold the first unit.

The first unit may be inserted into and turned on the second unit to be fastened is thereto.

The protrusion may be formed along a contact section extending from the lower edge of the optical member.

The protrusion may be placed corresponding to a cutout portion formed along an upper inner edge of the second unit, and comprises a first portion having an inclined surface.

The first portion may have a length smaller than or equal to the length of the cutout portion formed on the housing.

An adhesive may be applied to one side of the cutout portion.

The protrusion may be placed corresponding to a cutout portion formed along an upper inner edge of the second unit, and include a first portion having an inclined surface and a second portion extending from an upper side of the inclined surface to be parallel to a lower edge of the second unit.

The first portion and the second portion may have a length smaller than or equal to the length of the cutout portion formed on the housing.

The inclined surface of the first portion inserted into and turned in the cutout portion may contact one side of the cutout portion.

An adhesive may be applied to the one side of the cutout portion.

The protrusion may be placed corresponding to a cutout portion formed along an upper inner edge of the second unit, and include a first portion having an inclined surface and a third portion extending upward from one end of the inclined surface.

The first portion and the third portion may have a length smaller than or equal to the length of the cutout portion formed on the housing.

The third portion inserted into and turned in the cutout portion may have one is upper side contacting one side of the cutout portion.

An adhesive may be applied to the one side of the cutout portion.

The second unit may include a contact groove formed on the upper side of the housing so as to correspond to a lower side of the optical member.

The second unit may include a contact wall extending upward along an outer edge of the contact groove and corresponding to an outer side of the first unit.

The second unit may include a stop flange extending inwards along an upper edge of the contact wall, and a raised portion extending inwards along a lower edge of the contact wall and allowing the protrusion formed on the outer side of the first unit to be seated thereon.

The second unit may include a cutout portion formed in a forming direction of the stop flange.

The 'semiconductor optical device' described in the claims and the detailed description refers to a light emitting diode chip or the like including or employing an optical semiconductor.

The 'semiconductor optical device' may include package level devices including various types of optical semiconductors such as the aforementioned light emitting diode chip.

It is to be understood that both the foregoing general description and the following detailed description are exemplary and explanatory and are intended to provide further explanation of the invention as claimed.

BRIEF DESCRIPTION OF THE DRAWINGS

The above and other aspects, features and advantages of the present invention will become apparent from the following description of exemplary embodiments given in conjunction with the accompanying drawings, in which.

DETAILED DESCRIPTION OF THE ILLUSTRATED EMBODIMENTS

Figure 1:
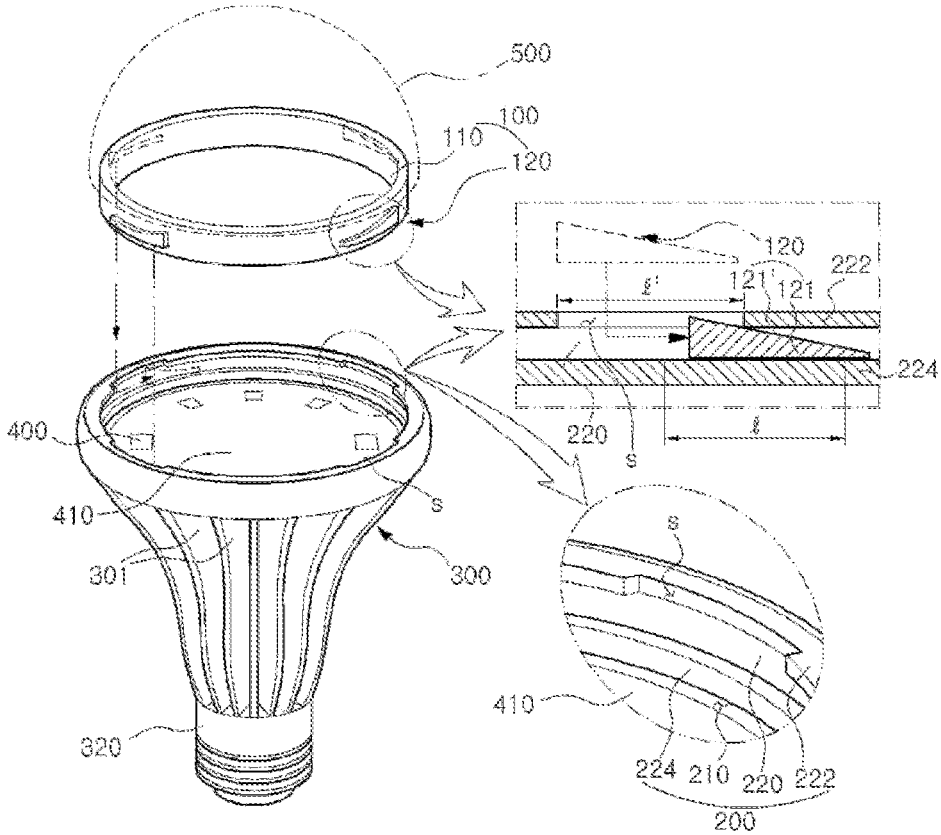
FIG. 1 is an exploded perspective view and a partially enlarged sectional view of an optical semiconductor based illuminating apparatus in accordance with one exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present. It will be understood that for the purposes of this disclosure, "at least one of X, Y, and Z" can be construed as X only, Y only, Z only, or any combination of two or more items X, Y, and Z (e.g., XYZ, XYY, YZ, ZZ).

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Next, exemplary embodiments of the present invention will be described in detail with reference to the accompanying drawings.

FIG. 1 is an exploded perspective view and a partially enlarged sectional view of an optical semiconductor based illuminating apparatus in accordance with one exemplary embodiment of the present invention.

As shown therein, this embodiment provides a structure wherein a first unit 100 provided to an optical member 500 is coupled to a second unit 200 provided to a housing 300, which is provided with a semiconductor optical device 400, such that the housing 300 and the optical member 500 can be fastened to each other.

In FIG. 1, reference numeral 320 indicates a socket base, and reference numeral 410 indicates a printed circuit board (PCB).

For reference, it should be noted that, in the views showing a coupling relationship between enlarged portions in the respective drawings including FIG. 1, the first is unit 100 and the second unit 200 of the enlarged portions are not actually coupled to each other, but some portions are enlarged and illustrated in the form of conceptual views for convenience in understanding of the drawings.

Figure 2:
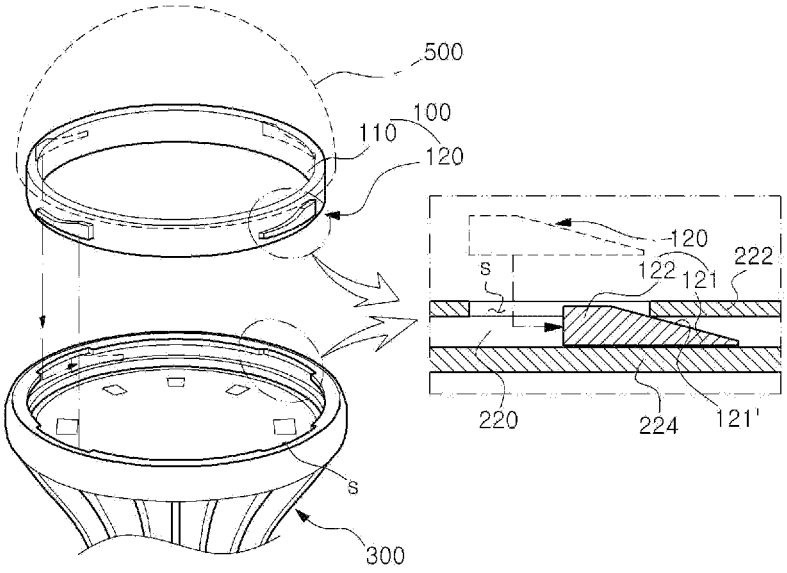
FIGS. 2 to 4 are exploded perspective views and partially enlarged sectional views of optical semiconductor based illuminating apparatuses in accordance with other exemplary embodiments of the present invention.
Figure 3:
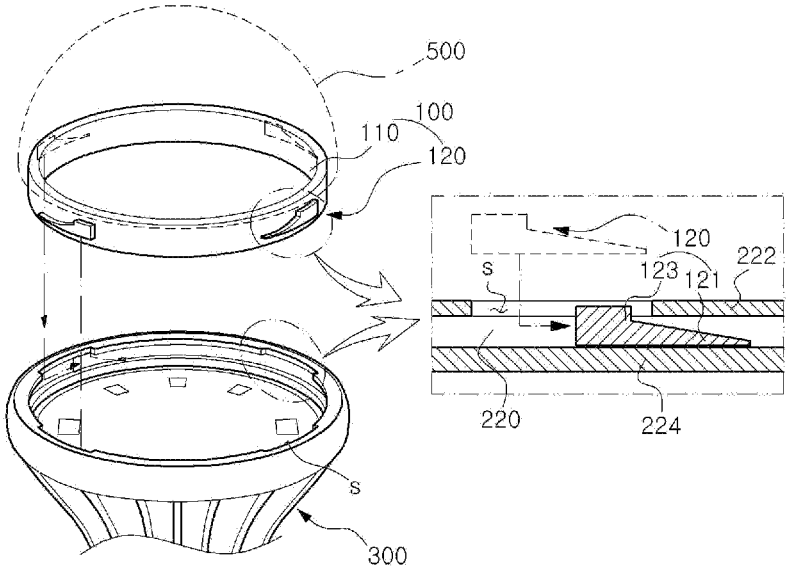
Figure 4:
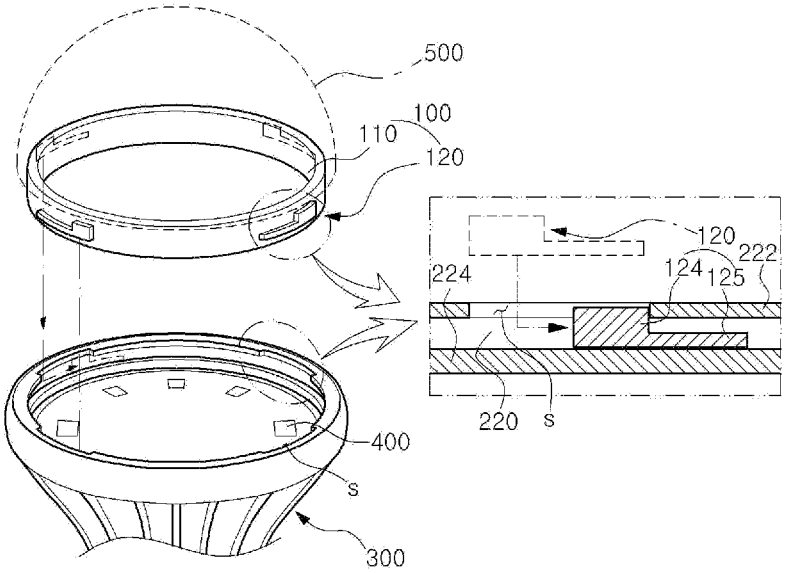

Also, l and l' shown to indicate the length in FIG. 1 are not shown in FIGS. 2 to 4, but will be commonly applied thereto.

The housing 300 is disposed on the socket base 320 and provided with heat dissipation fins 301, and the semiconductor optical device 400 is disposed on the housing 300 and serves as a light source.

The optical member 500 is made of a transparent or translucent material. The optical member 500 surrounds the semiconductor optical device 400 from top of the housing 300, diffuses or concentrates light emitted from the semiconductor optical device 400, and protects the semiconductor optical device 400.

The first unit 100 is formed on a lower outer side of the optical member 500, and includes protrusions 120 each having an inclined surface 121' inclined upwards from a lower edge of the optical member 500.

The second unit 200 is formed on an upper side of the housing 300 to accommodate and hold the first unit 100.

Here, the first unit 100 and the second unit 200 are supported by each other at positions equally spaced along the circumferences of the housing 300 and the optical member 500, respectively. Therefore, coupling force can be uniformly distributed and coupling therebetween can be firmly maintained.

The present invention provides the foregoing embodiment and may also include various exemplary embodiments as follows.

The first unit 100 is inserted into and turned on an upper side of the housing 300, i.e., on the second unit 200, to be locked therewith. The first unit 100 may further include a contact section 110 extending from the lower edge of the optical member 500 to provide a contact surface when inserted into the second unit 200.

Here, the contact section 110 includes the protrusions 120 equally spaced along a circumferential surface of the contact section 110 to firmly maintain the fastened state to the second unit 200.

Here, each of the protrusions 120 may include a first portion 121, which is configured to allow the protrusion 120 to be inserted into and turned on a cutout portion s until the inclined surface of the first portion 121 is brought into surface contact with a cutout portion described below.

Specifically, the first portions 121 protrude from the contact section 110 and are placed corresponding to the cutout portions s equally spaced along upper inner edges of the second unit 200.

The first portion 121 moves on a raised portion 224 and includes an inclined surface 121' inclined downwards in a direction of being inserted into and turned in the cutout portion s.

Here, the length l of the first portion 121 formed along the circumference of the contact section 110, i.e. the length l of a lower edge of the first portion 121, may be smaller than or equal to the length l' of the cutout portion s formed along the circumference of the housing 300.

Thus, the inclined surface 121' formed on the first portion 121, which is inserted into and turned in the cutout portion s in an arrow direction shown by a dash-dot line, will be is brought into contact with one side of the cutout portion s. Further, an adhesive is applied to the one side of the cutout portion s to keep a fastened state with respect to the inclined surface 121'.

Meanwhile, the second unit 200 accommodates the first unit 100 and holds the turned first unit 100 at a certain position as described above. The second unit 200 includes a contact groove 210 formed on an upper side of the housing 300 so as to correspond to a lower side of the optical member 500, i.e., a lower edge of the contact section 110.

Here, the second unit 200 further includes a contact wall 220 extending upwards along an outer edge of the contact groove 210 and corresponding to an outer surface of the contact section 110 to provide a contact space with the protrusion 120.

At this time, the second unit 200 further includes a stop flange 222 extending inwards along an upper edge of the contact wall 220 to provide a moving space of the protrusion 120.

The second unit 200 further includes the raised portion 224 which extends inwards along a lower edge of the contact wall 220 to provide the moving space of the protrusion 120, and on which the protrusions 120 equally spaced on the first unit 100 are seated.

Thus, the protrusions 120 may be turned between the stop flange 222 and the raised portion 224.

The second unit 200 may further include the cutout portions s equally spaced corresponding to the number of protrusions 120 in a forming direction of the stop flange 222, such that the first unit 100, i.e. the protrusions 120, can be smoothly inserted into the cutout portions.

In another exemplary embodiment of the present invention, the illuminating apparatus may have a structure wherein a first portion 121 is inclined and extends from a second portion 122 such that the first portion 121 can be moved without stopping while the protrusion 120 is inserted into and turned in the cutout portion s, and can be stopped by surface contact between the inclined surface and the cutout portion, as shown in FIG. 2.

Specifically, the first portion 121 is inclined downwards and extends from one side of the second portion 122 along the circumference of the contact section 110, and may move together with the second portion 122 on the raised portion 224.

Here, the length l of each of the first portion 121 and the second portion 122 formed along the circumference of the contact section 110, i.e. the length l of the lower edge of each of the first and second portions 121, 122, may be smaller than or equal to the length l' of the cutout portion s formed along the circumference of the housing 300.

Thus, the inclined surface 121' formed on the first portion 121, which is inserted into and turned in the cutout portion s in an arrow direction shown by a dash dot line, will be brought into contact with one side of the cutout portion s. Further, an adhesive is applied to the one side of the cutout portion s to keep a fastened state with respect to the inclined surface 121'.

In a further exemplary embodiment of the present invention, the illuminating apparatus may have a structure wherein a first portion 121 is inclined and extends from a third portion 123 such that the first portion 121 can be moved without stopping while the protrusion 120 is inserted into and turned in the cutout portion s, as shown in FIG. 3.

Specifically, the first portion 121 is inclined downwards and extends from a lower side of the third portion 123 along the circumference of the contact section 110, and may move together with the third portion 123 on the raised portion 224.

Here, the length l of each of the first portion 121 and the third portion 123 formed along the circumference of the contact section 110, i.e. the length l of the lower edge of each of is the first and third portions 121, 123, may be smaller than or equal to the length l' of the cutout portion s formed along the circumference of the housing 300 such that the protrusion 120 can be smoothly inserted into the cutout portion s.

Thus, an upper one side of the third portion 123, which is inserted into and turned in the cutout portion s in an arrow direction shown by a dash dot line, will be brought into contact with one side of the cutout portion s. Further, an adhesive is applied to the one side of the cutout portion s to ensure a fastened state with respect to the upper one side of the third portion 123.

In still another exemplary embodiment of the present invention, the illuminating apparatus may have a structure wherein each of protrusions 120 has fourth and fifth portions 124, 125, as shown in FIG. 4.

In this embodiment, each of the protrusions 120 includes the fourth portion 124 and the fifth portion 125 extending from the fourth portion 124.

The fourth portions 124 protrude from the contact section 110 and are placed corresponding to the cutout portion s equally spaced along an upper inner edge of the second unit 200.

The fifth portion 125 extends from a lower one side of the fourth portion 124 along the circumference of the contact section 110 and moves together with the fourth portion 124 on the raised portion 224 formed along the lower inner edge of the second unit 200.

Here, the length l of each of the fourth and fifth portions 124, 125 formed along the circumference of the contact section 110, i.e., the length l of the lower edge of each of the fourth and fifth portions 124, 125, may be smaller than or equal to the length l' of the cutout portion s formed along the circumference of the housing 300 such that the protrusion 120 can be is smoothly inserted into the cutout portion s.

Thus, the fourth portion 124, which is inserted into and turned in the cutout portion s in an arrow direction shown by a dash dot line, has one upper side brought into contact with one side of the cutout portion s. Further, an adhesive (not shown) is applied to the one side of the cutout portion s to keep a fastened state to the one upper surface of the fourth portion 123.

As such, the exemplary embodiments of the present invention provide optical semiconductor based illuminating apparatuses which may reduce defect rate, improve assembly efficiency, and has excellent durability.

With the foregoing structure, exemplary embodiments of the present invention provide the following effects.

First, the first unit on the lower side of the optical member is inserted into the second unit on the upper side of the housing and then turned by a predetermined angle such that the first and second units can be fastened to each other, thereby allowing convenient assembly while improving productivity.

Further, the first unit is formed with protrusions and the second unit is formed with cutout portions such that the protrusions can be inserted into and turned in the cutout portions to be fastened thereto, with an adhesive applied to one side of the cutout portion, whereby coupling force between the optical member and the housing can be maintained, thereby reducing defect rate while improving durability.

Particularly, according to exemplary embodiments of the present invention, when fastening the optical member to the housing, each of the protrusions of the first unit is inserted and turned within the corresponding cutout portion of the second unit until the protrusion is stopped and held by one side of the cutout portion, thereby minimizing tolerance between the is housing and the optical member while reducing unnecessary operation as compared with conventional methods.

Although some exemplary embodiments have been described herein, it should be understood by those skilled in the art that these embodiments are given by way of illustration only, and that various modifications, variations, and alterations can be made without departing from the spirit and scope of the present invention. The scope of the present invention should be limited only by the accompanying claims and equivalents thereof.

What is claimed is:

1. An optical semiconductor based illuminating apparatus comprising:

a housing;

at least one semiconductor optical device formed on an upper side of the housing;

an optical member disposed on the upper side of the housing;

a first unit formed on a lower outer side of the optical member and comprising a protrusion having an inclined surface inclined from a lower edge of the optical member; and a second unit formed on the upper side of the housing to accommodate and hold the first unit, wherein:

the inclined surface of the protrusion contacts one side of a cutout portion formed on the second unit;

the protrusion comprises a first portion placed corresponding to a cutout portion formed along an upper inner edge of the second unit, the first portion having the inclined surface, and a second portion extending from an upper side of the inclined surface to be parallel to a lower edge of the second unit; and a total length of the first portion and the second portion is smaller than or equal to the length of the cutout portion formed on the housing.

2. The illuminating apparatus according to claim 1, wherein the first unit is inserted into and turned on the second unit.

3. The illuminating apparatus according to claim 1, wherein the protrusion is formed along a contact section extending from the lower edge of the optical member.

4. The illuminating apparatus according to claim 1, wherein an adhesive is applied to the one side of the cutout portion.

5. The illuminating apparatus according to claim 1, wherein the inclined surface of the first portion inserted into and turned in the cutout portion contacts the one side of the cutout portion.

6. The illuminating apparatus according to claim 5, wherein an adhesive is applied to the one side of the cutout portion.

7. The illuminating apparatus according to claim 1, wherein the second unit comprises a contact groove formed on the upper side of the housing so as to correspond to a lower side of the optical member.

8. The illuminating apparatus according to claim 7, wherein the second unit further comprises a contact wall extending upward along an outer edge of the contact groove and corresponding to an outer side of the first unit.

9. The illuminating apparatus according to claim 8, wherein the second unit further comprises a stop flange extending inwards along an upper edge of the contact wall, and a raised portion extending inwards along a lower edge of the contact wall and brought into contact with the protrusion formed on the outer side of the first unit.

10. The illuminating apparatus according to claim 9, wherein the second unit further comprises a cutout portion formed in a forming direction of the stop flange.

* * * * *